US007926214B2

(12) United States Patent
Conway et al.

(10) Patent No.: US 7,926,214 B2
(45) Date of Patent: Apr. 19, 2011

(54) TWO-WAY ADJUSTABLE SIGN SYSTEM

(75) Inventors: Thomas M. Conway, Park Ridge, IL (US); Scott Padiak, Skokie, IL (US); Paul C. Evans, Bellaire, MI (US)

(73) Assignee: Cormark, Inc., Des Plaines, IL (US)

( * ) Notice: Subject to any disclaimer, the term of this patent is extended or adjusted under 35 U.S.C. 154(b) by 236 days.

(21) Appl. No.: 12/098,246

(22) Filed: Apr. 4, 2008

(65) Prior Publication Data

US 2009/0249668 A1 Oct. 8, 2009

(51) Int. Cl.
*G09F 1/12* (2006.01)

(52) U.S. Cl. ..... 40/606.13; 40/739

(58) Field of Classification Search ..... 40/606.13, 40/739–741

See application file for complete search history.

(56) References Cited

U.S. PATENT DOCUMENTS 1,202,321 A * 10/1916 Schleicher ..... 40/741
1,253,847 A * 1/1918 Lynch ..... 40/606.17
1,335,854 A * 4/1920 O'Callahan ..... 160/374
1,393,616 A * 10/1921 Foster ..... 160/373
1,913,000 A * 6/1933 Woller ..... 40/209
2,866,286 A * 12/1958 Hartman ..... 40/741
3,465,461 A * 9/1969 Price et al. ..... 40/741
4,117,614 A * 10/1978 Bickford ..... 40/741
4,205,470 A * 6/1980 Kapnek ..... 40/782
4,279,288 A * 7/1981 Lanier ..... 160/374
5,448,841 A * 9/1995 Hampton ..... 40/730
5,803,420 A 9/1998 Conway et al.
6,470,611 B1 10/2002 Conway et al.
7,137,606 B2 11/2006 Conway et al.
7,207,536 B2 4/2007 Conway et al.
2002/0104246 A1 * 8/2002 Reynolds ..... 40/642.02

* cited by examiner

*Primary Examiner* — Cassandra Davis
(74) *Attorney, Agent, or Firm* — Levenfeld Pearlstein, LLC

(57) ABSTRACT

A device for a two-way adjustable sign system for mounting to a shelf, the device comprising a frame having an upper rail, a lower rail, and a first and a second side bracket, the upper rail and the lower rail each having an inner and an outer rail, wherein the inner rail is slidably moveable within the outer rail, and wherein the first and second side brackets each have an inner and outer bracket wherein the inner bracket is slidably movable within the outer bracket.

12 Claims, 10 Drawing Sheets

TWO-WAY ADJUSTABLE SIGN SYSTEM

BACKGROUND OF THE INVENTION

The present invention is directed to a sign mounting system. More particularly, the present invention pertains to an easily mounted sign display system with an adjustable perimeter frame.

Signs are everywhere. Signs and their mounts are available in a wide array of sizes, designs, and mounting arrangements. Hundreds of different types of signs and sign systems are used in retail and "big-box" store settings. Typically, traditional stationary signs are mounted to support structures such as shelving, or from a vertical support element such as a shelf standard at the rear of shelves, or to vertical standards at the front of shelves. Such signs provide readily visible pictures and/or verbiage to direct consumers to merchandise stocked on the shelves.

Signs are quite effective in directing a consumer's attention to a particular location, item, or product. However, signs typically must be mounted to shelf beams in particular, predetermined ways, allowing merchants little flexibility in designing displays. In addition many known sign mounting systems are permanent installations, so that removing and relocating the mounting systems is complicated, if not impossible. Many known signs and sign-holders are attached to their mounts via screws, hinges, or other mechanical elements. Even if these signs and sign-holders can be relocated to other sites, the additional elements increase the overall cost of the signs as well as the labor required to mount them effectively.

Furthermore, many sign mounting systems are too large and cumbersome to fit with many warehouses and warehouse stores shelves. Instead, these signs must be placed to the side or in another, less immediate location. Storage as well as convenience of display can become problematic for merchants.

Accordingly, there is a need for an adjustable sign mounting system that is adjustable both horizontally as well as vertically. Desirably, such a sign mounting system is flexible and can be used with any of a variety of types of retail display arrangements. More desirably, such a sign mounting system is easily assembled, mounted, removed, and manufactured with a high degree of integrity at reduced cost.

BRIEF SUMMARY OF THE INVENTION

A two-way adjustable sign system is configured for mounting to a shelf. The system has a frame attached to the shelf. The frame has an upper rail, a lower rail, and first and second side brackets. The upper rail and the lower rail each have an inner and an outer rail. The inner rail is slidably moveable within the outer rail. The first and second side brackets each have inner and outer brackets with the inner bracket slidably movable within the outer bracket.

The upper rail has a C-shaped cross-section. The first lip of the upper rail extends forward of a second lip of the upper rail forming a recess for a sign to be positioned. The lower rail has a C-shaped cross-section also with a first lip of the lower rail extending forward of a second lip of the lower rail forming a well for a sign to sit. The upper and lower rails have a latching mechanism affixed to the inner rail and engages an aperture in the outer rail.

The first bracket has at least two tongues capable of engaging the upper rail and at least two tongues capable of engaging the lower rail. The second bracket has at least two tongues capable of engaging the upper rail and at least two tongues capable of engaging the lower rail.

The upper ends of the first and second side brackets have cutouts allowing for clearance for mounting and the frame is mounted to the shelf without using tools. The first and second side brackets have hook-like projections to mount the frame to the shelf. The first and second side brackets also have at least one T-shaped tab to mount the frame to the shelf. The upper rail and lower rails are formed from a metal and the first and second side brackets are formed from a polymer.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
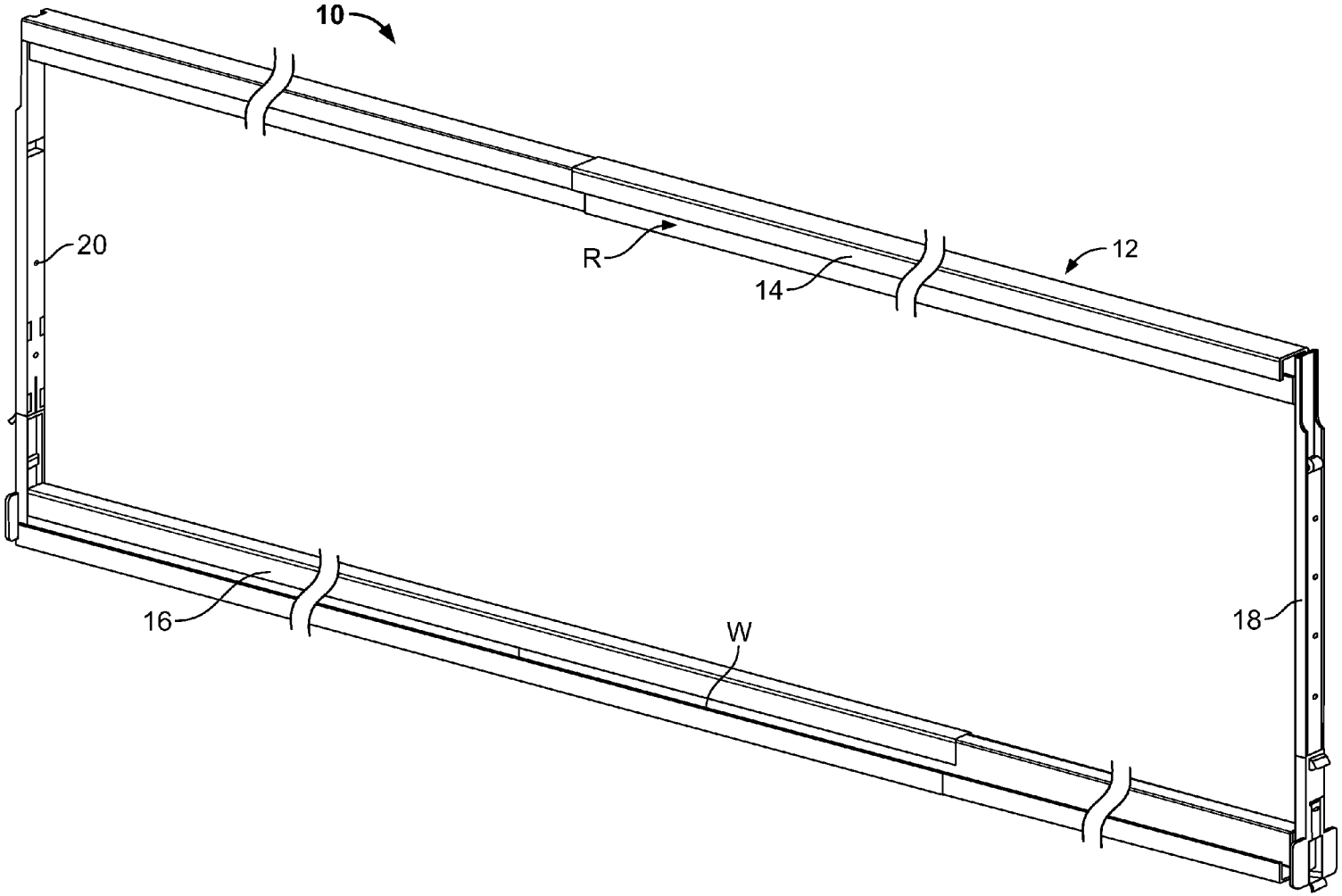
FIGS. 1 and 2 are perspective views (assembled and exploded, respectively) of the two-way adjustable sign mounting system embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular FIG. 1, an embodiment of the two-way adjustable sign system 10 is illustrated. The two-way adjustable sign system 10 can be adjusted vertically and horizontally to accommodate various sizes and shapes of signs, as well as accommodate multiple signs simultaneously. The two-way adjustable sign system 10 includes a frame 12 with adjustable upper and lower rail members 14, 16 respectively, for supporting the media, and two adjustable vertical brackets 18, 20 for attaching the frame 12 to the shelving.

Figure 2:
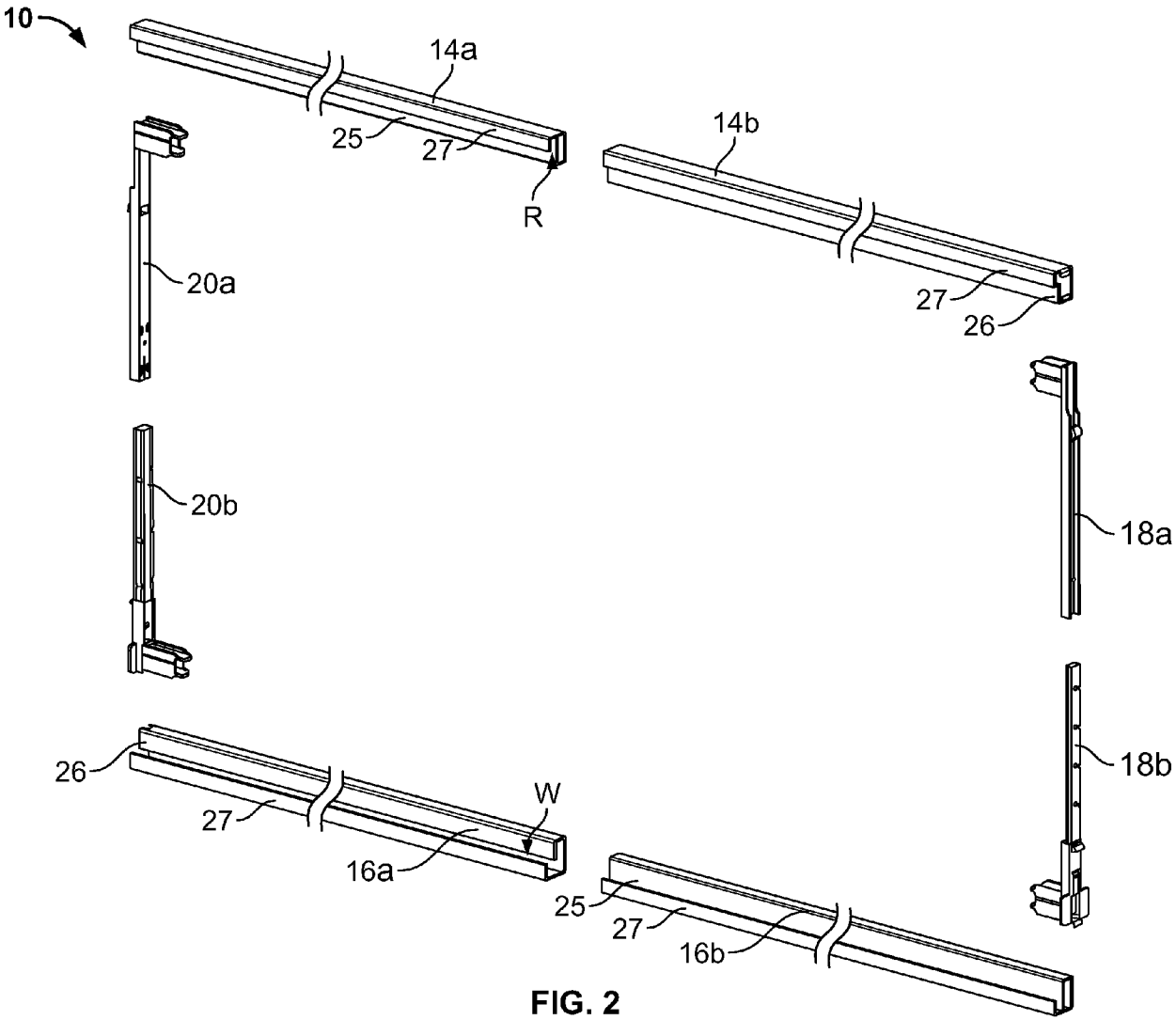

The adjustable upper and lower rails 14, 16 are shown in FIG. 2. Upper rail 14 and lower rail 16 are mirror images of each other. The upper rail 14 is composed of two components: an inner rail 14*a* and an outer rail 14*b*. Similarly, the lower rail 16 is composed of an inner rail 16*a* and an outer rail 16*b*. The inner rail 14*a* slides within the outer rail 14*b*. Similarly, inner rail 16*a* slides within the outer rail 16*b*. Rail portions 14*a* and 14*b* combine to form upper rail 14. Rail portions 16*a* and 16*b* combine to form lower rail 16. The slidable, telescoping nature of the rails 14 and 16 allows a user to adjust the length of the frame to accommodate several lengths of signage and to accommodate different bay widths (distances between the sign system uprights).

Figure 3A:
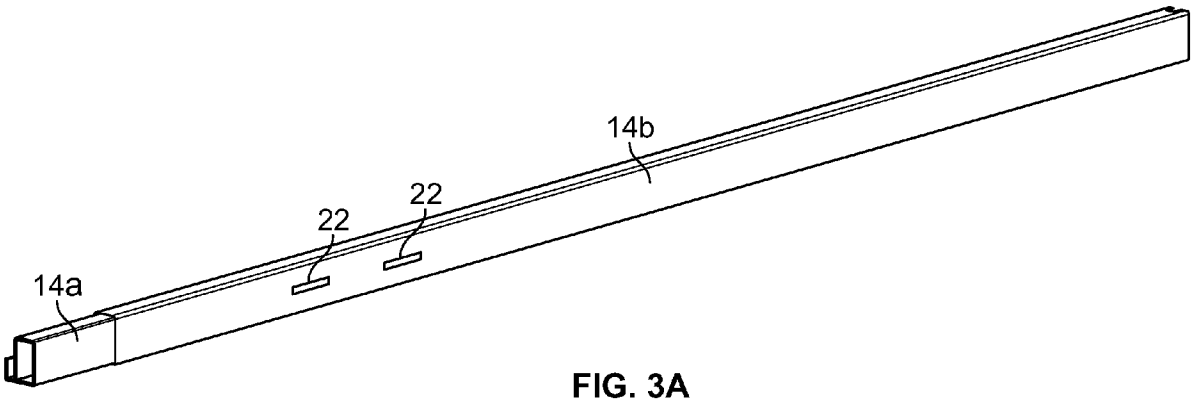
FIGS. 3A-3B are perspective views of the lower rail illustrating the telescoping nature and latch mechanism of the two-way adjustable system.
Figure 3B:
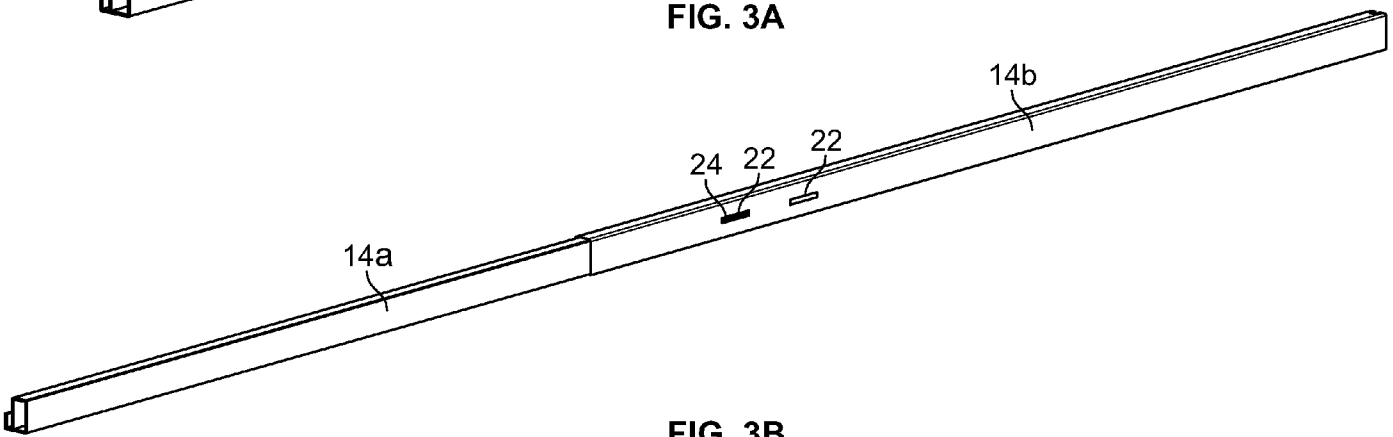
Figure 3C:
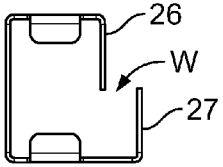
FIG. 3C is an end view of the outer rail as seen from the right-hand side of FIG. 3A.

The outer rails 14*b*, 16*b* are shown in FIGS. 2-3C. The outer rails 14*b*, 16*b* have an offset or asymmetrical C-shaped cross-sectional area, as shown in FIG. 3C. A first lip 27 of the outer rail 14*b*, 16*b* protrudes slightly forward of a second lip 26, forming a well W in the lower rail 16*b* and a recess R in the upper rail 14*b*.

Likewise, the inner rail 14*a*, 16*a* has a cross-sectional profile having a first lip 27 positioned slightly forward of a wall 25. The first lip 27 and the wall 25 form a well W for the lower rail 16*a* and a recess R for the upper rail 14*a*. The first lip 27 of both the upper and lower rails 14, 16 provides front support for a sign when the sign is placed in the well W and recess R of the frame 12 so the sign does not fall forward. The well W and recess R provide a track in which the sign can be slid.

Figure 4A:
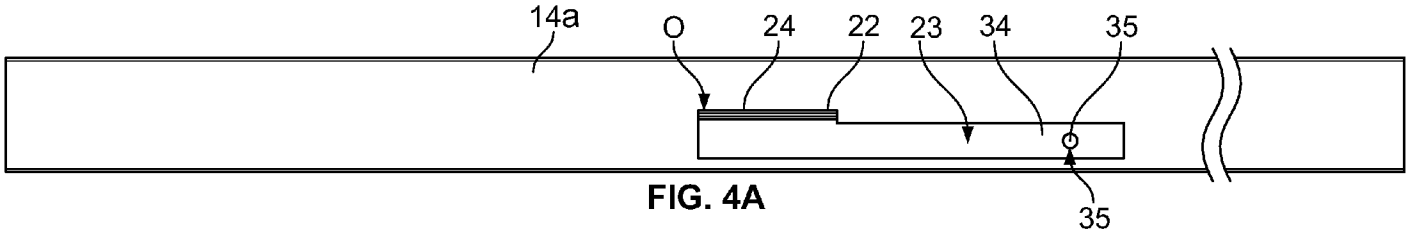
FIG. 4A-B are top and side views respectively, showing the latching mechanism.
Figure 4B:
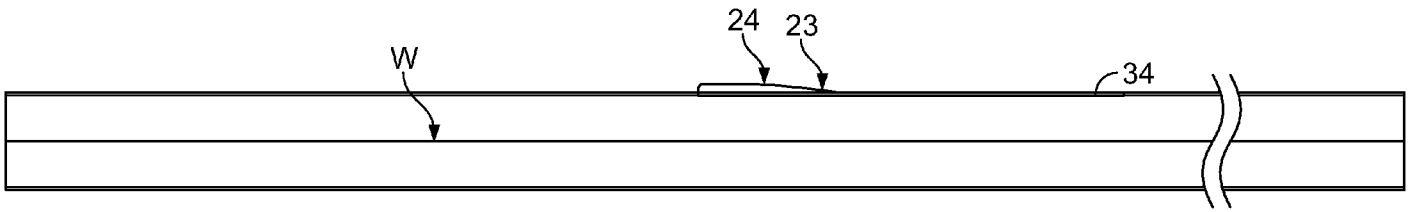
Figure 4C:
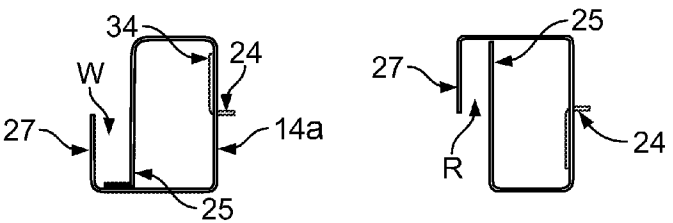
FIG. 4C are cross-sectional views of the inner rail.
Figure 5A:
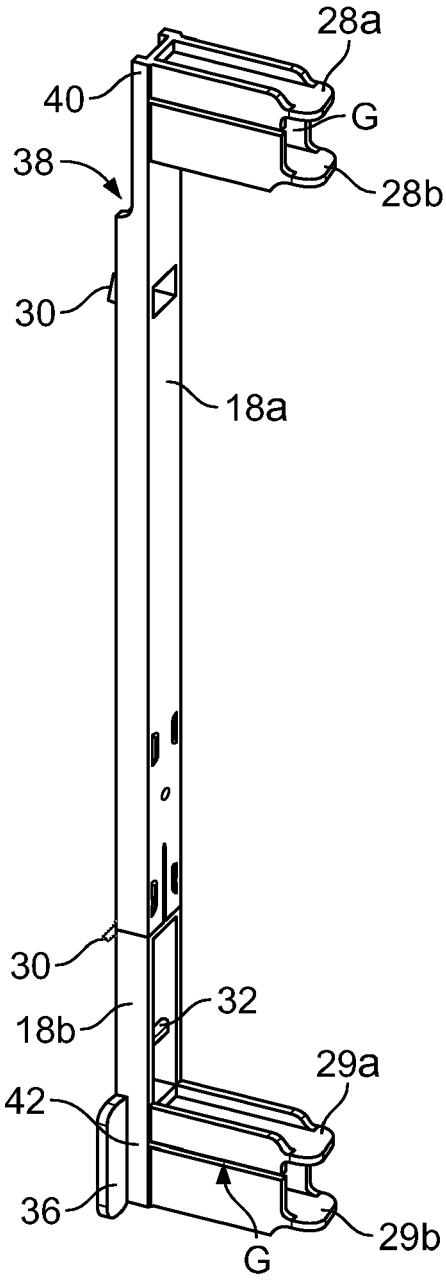
FIG. 5A-5B are perspective views of the side brackets shown collapsed (FIG. 5A) and expanded (FIG. 5B)
Figure 5B:
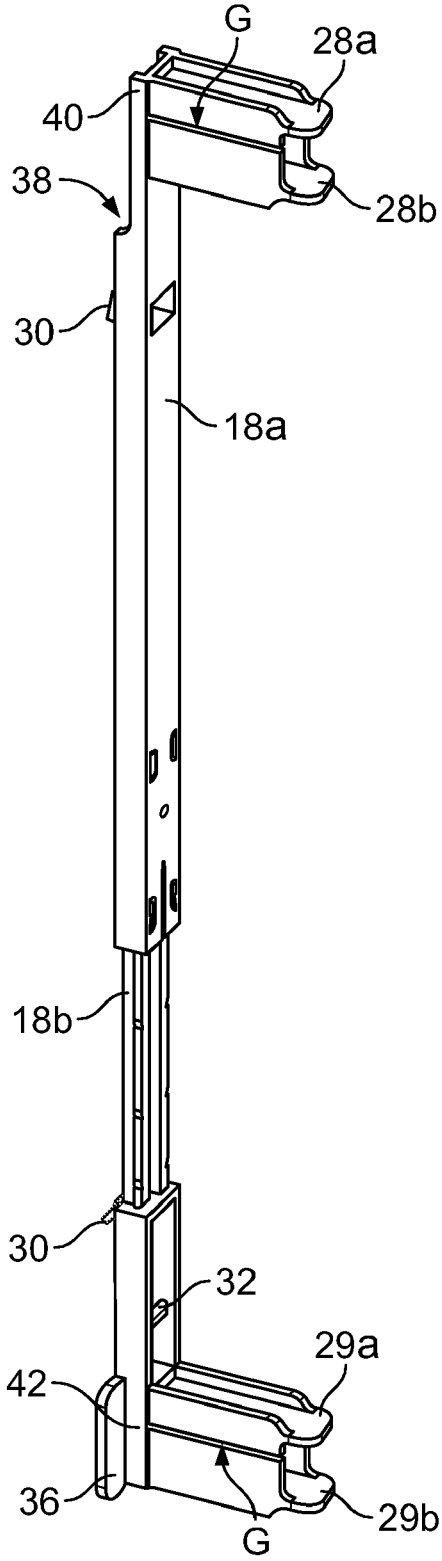
Figure 6:
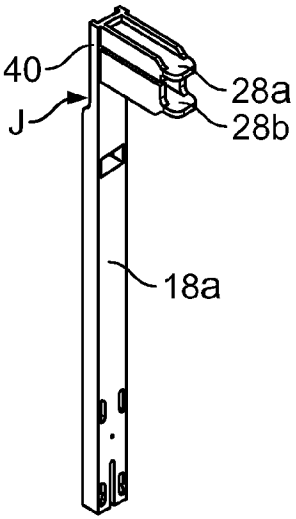
FIG. 6 is a perspective view of one of the outer brackets.
Figure 6D:
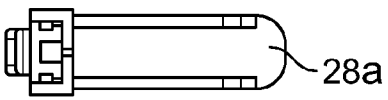
FIG. 6D is a plan view of the side bracket of FIG. 6.
Figure 6A:
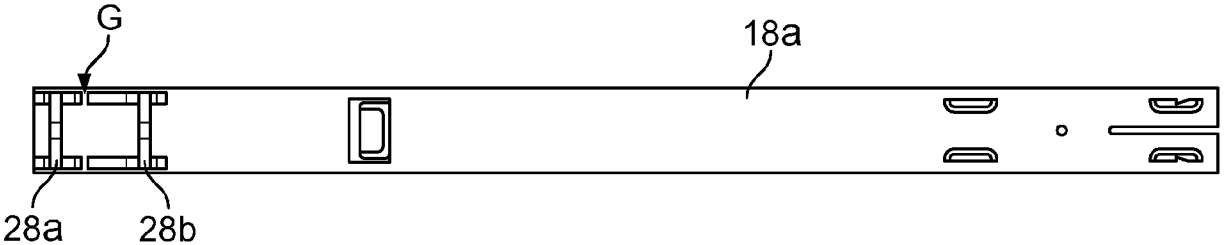
FIG. 6A-6C are various views of the outer side bracket of FIG. 6.
Figure 6B:
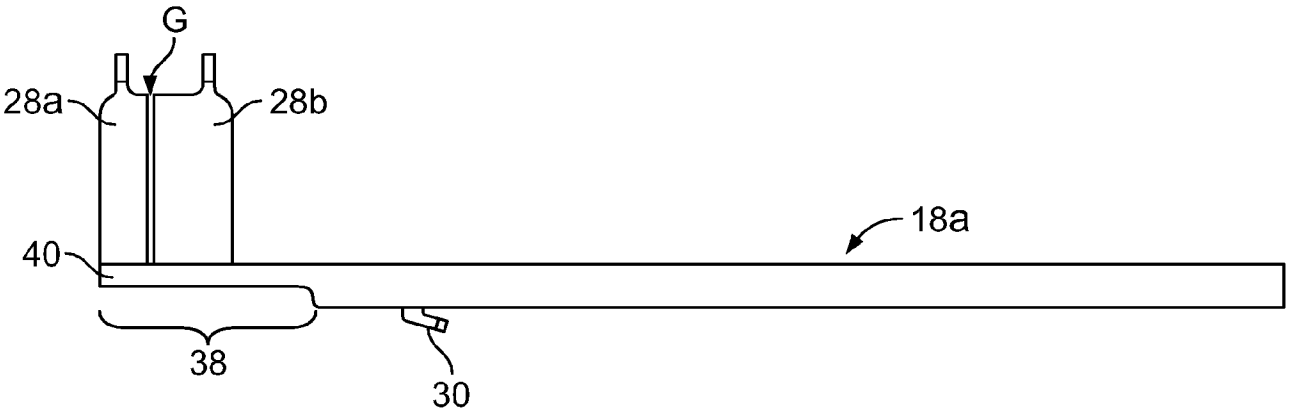
Figure 6C:
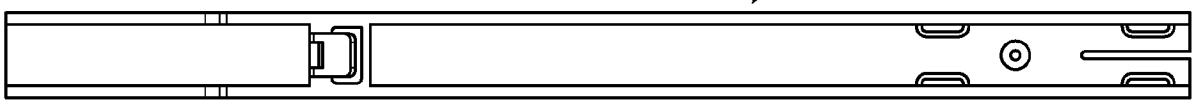
Figure 7:
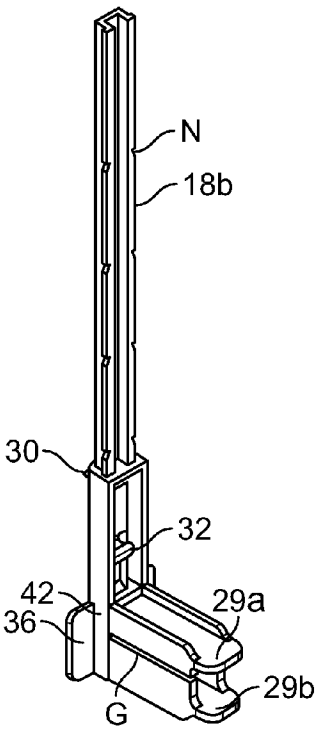
FIG. 7 is a perspective view of one of the inner side brackets of the present invention.
Figure 7D:
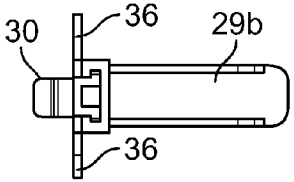
FIG. 7D is a plan view of the inner side bracket of FIG. 7.
Figure 7A:
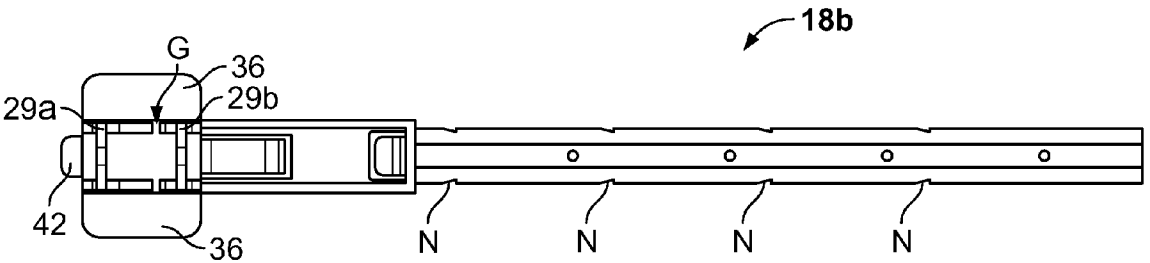
FIG. 7A-C are various views of the inner side bracket of FIG. 7.
Figure 7B:
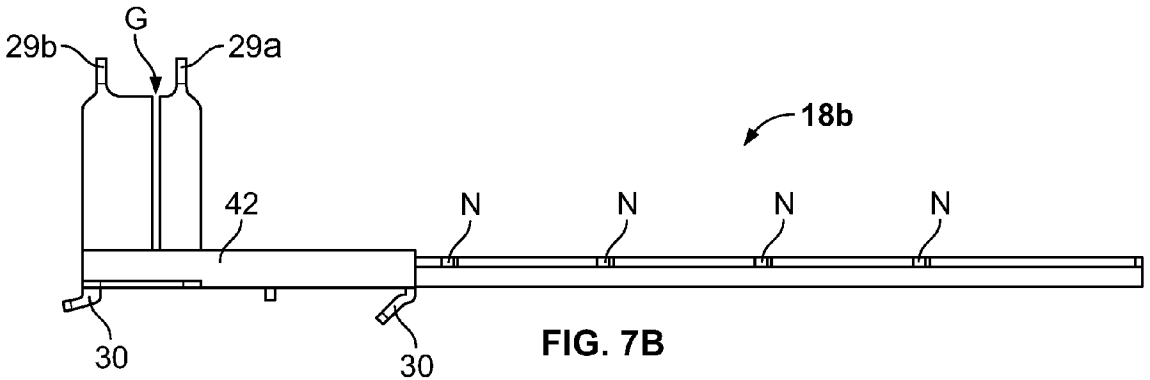
Figure 7C:
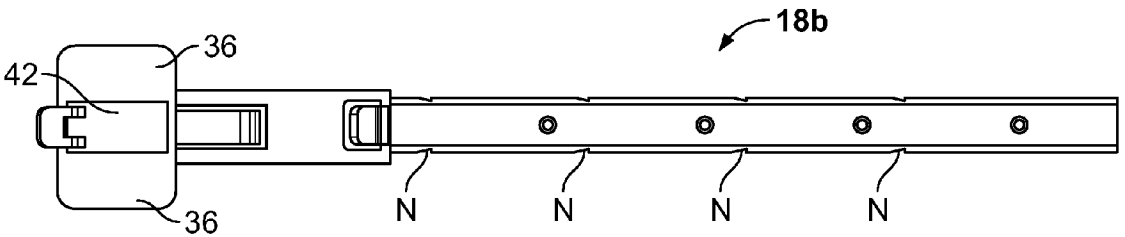

Attached to the inner rail 14*a*, shown in FIGS. 4A-4C, is a latching mechanism 23 with a head 24 and a base 34. The base 34 of the latching mechanism 23 is affixed to the interior of the inner rail 14*a* by rivets or spot welding as at 35. The head 24 of the latching mechanism 23 is biased and extends through a slotted opening 21 in the inner rail 14*b*.

As the inner rail 14*a*, 16*a* slides within their respective outer rail 14*b*, 16*b*, the latching mechanism 23 of the inner rail 14*a*, 16*a* engages one of a number of apertures 22 of the outer rail 14*b*, 16*b* when the desired length of the frame 12 is achieved. The latching mechanism's head 24 engages the aperture 22 and holds the inner rail 14*a*, 16*a* in place relative to the outer rail 14*b*, 16*b*. To disengage the latching mechanism 23 in the present embodiment, the head 24 is depressed and is released from the aperture 22, allowing the inner rail 14*a*, 14*b* to slide freely again. Because the head 24 is biased in a forward direction, the head 24 will engage the next aperture 22 if the rails, both inner and outer, are properly aligned. Thus, the rails 14, 16 can be adjusted to accommodate various sizes of signage.

Referring now to FIGS. 5A-7D, there is shown an embodiment for the side brackets 18. Just as the upper rail 14 and the lower rail 16 are mirror images of each other, so too are side brackets 18 and 20 mirror images to each other. The side brackets 18, 20 also each have slidable elements: an inner bracket 18*a*, 20*a* and an outer bracket 18*b*, 20*b*. Inner side bracket 18*a*, 20*a* slides/telescopes within the outer side bracket 18*b*, 20*b* to enable the frame to accommodate multiple and varying sizes/heights of signs. In order to secure the slidable elements 18*a*, 20*a* in the outer brackets 18*b*, 20*b*, a locking means is provided to secure the 18*a*, 20*a* in a number of positions.

Side bracket 18 has an upper end 40 and a lower end 42, wherein the upper has tongue portions 28*a* and 28*b* and the lower end 42 has tongue portions 29*a* and 29*b*. The tongues portions 28*a,b*, 29*a,b* are used to engage the upper and lower rails 14 and 16. The upper end 40 of the side bracket 18 engages upper rail 14 and the lower end 42 of the bracket 18 engages lower rail 16. The upper end 40 of the side bracket 18 is formed with two tongue portions in order that a user has the option of engaging the rail 14 to the top tongue portion 28*a* or to the bottom tongue portion 28*b*. In this manner, either the entire tongue 28*a* and 28*b* is captured in the rail 14, or only the inner tongue portion 28*b* is captive within rail 14.

Side bracket 20 likewise has an upper end 40 and a lower end 42, wherein the upper end 40 has tongue portions 28*a* and 28*b* and the lower end 42 has tongue portions 29*a* and 29*b*. The tongue portions are used to engage the upper and lower rails 14 and 16. The upper end 40 of the side bracket 20 engages upper rail 14 and the lower end 42 of the bracket 20 engages lower rail 16. A gap G is present between 28*a* and 28*b* and between 29*a* and 29*b* in order that a user has the option of engaging the rail to the entire tongue portion 28*a* and 28*b* or to the bottom tongue portion 28*b* only when clearance is an issue.

Figure 8B:
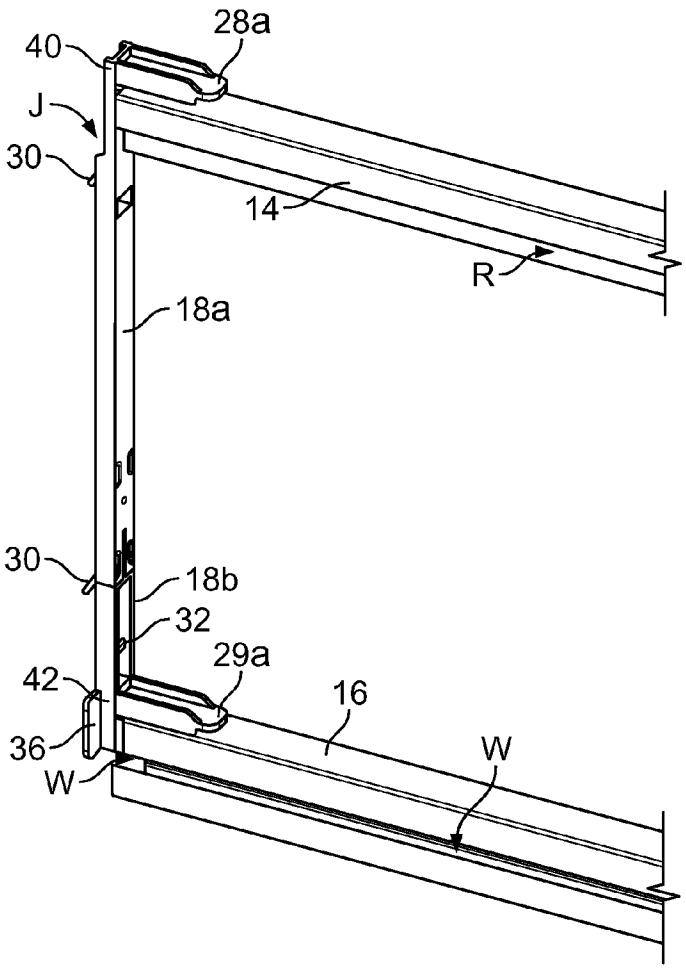
FIG. 8A is a side view and FIG. 8B is a perspective view of the upper and lower rails engaging the lower portion of the tongue of the one side bracket.
Figure 8A:
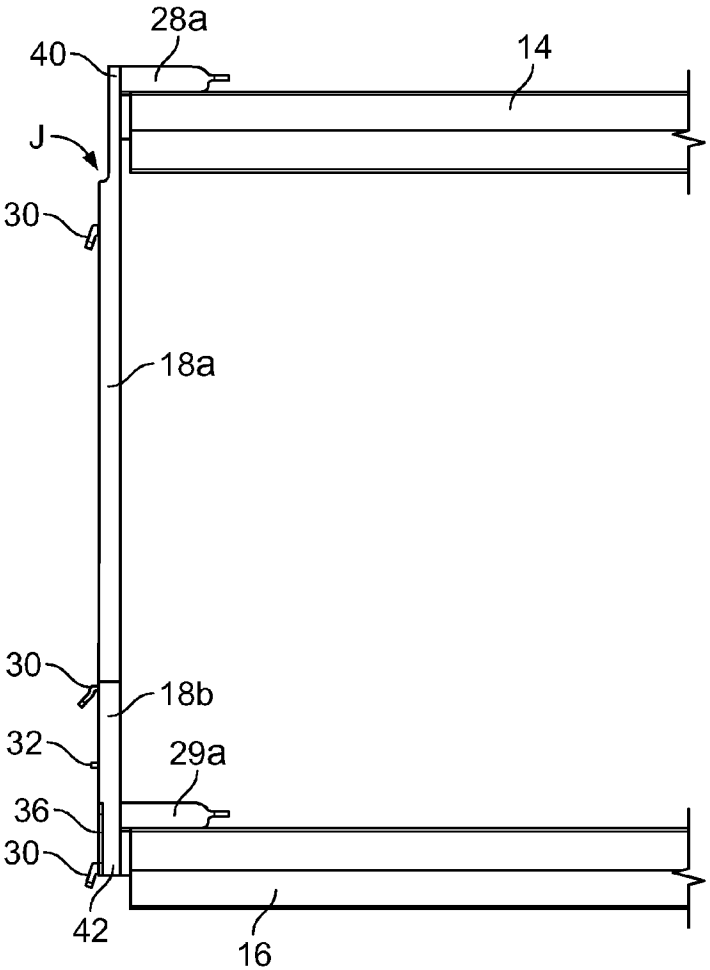

When clearance is an issue, such as when the frame is being mounted below a shelf S making use of the top tongue 28*a* inappropriate, then the user has the option of engaging the upper rail 14 with the second tongue 28*b*, as shown in FIGS. 8A and 8B. In this way, the frame 12 allows for mounting either above or below a shelf S. Similarly, the lower rail 16 also can be fitted onto the lower end 42 of the side brackets 18, 20 at either the top or bottom tongue 29*a*, 29*b*, such that when mounted, the frame 12 buttresses the shelf S at the bottom of the frame 12.

Figure 8C:
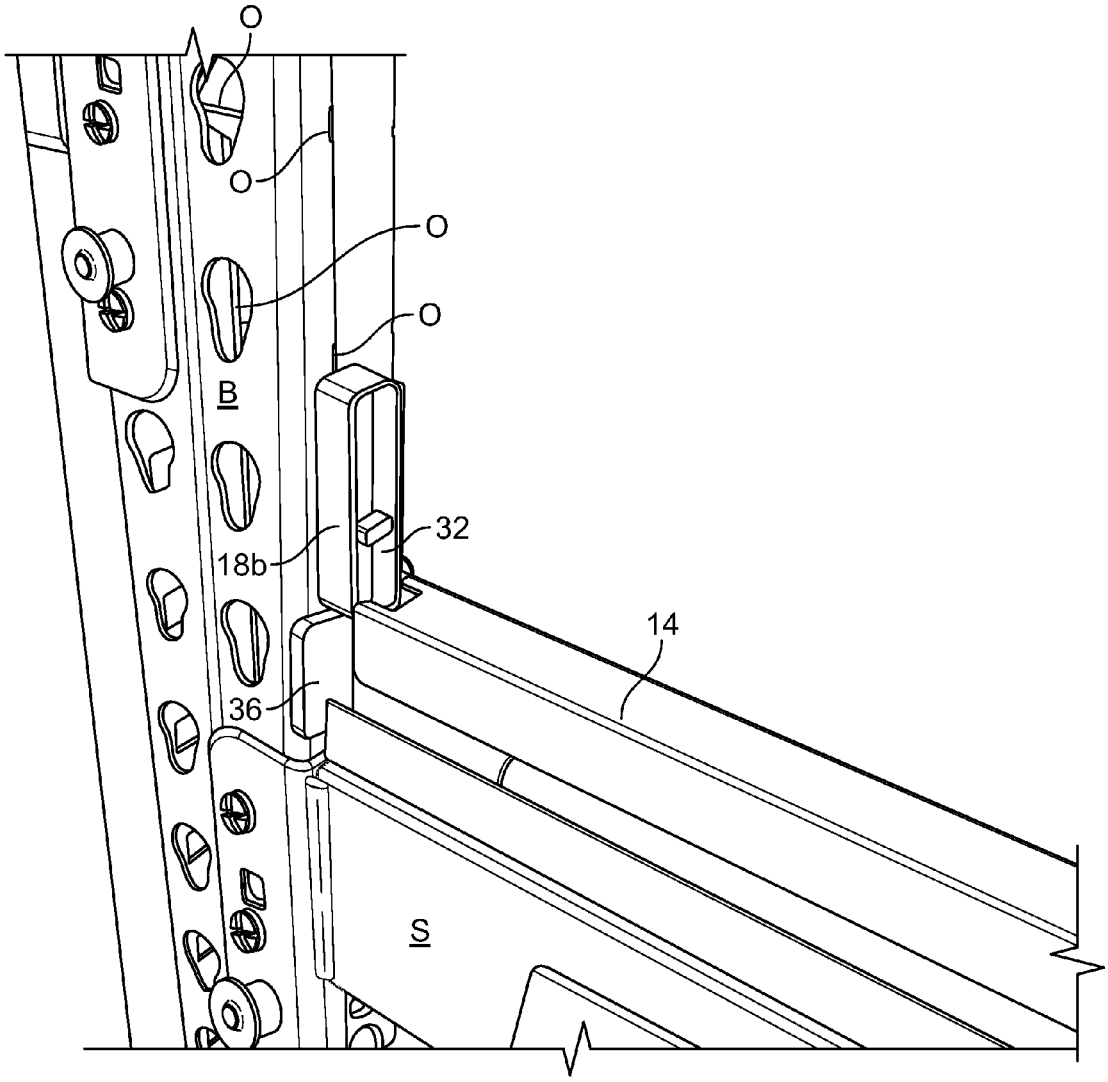
FIG. 8C is a perspective view of the lower rail engaging both tongue portions of the lower side bracket.
Figure 9:
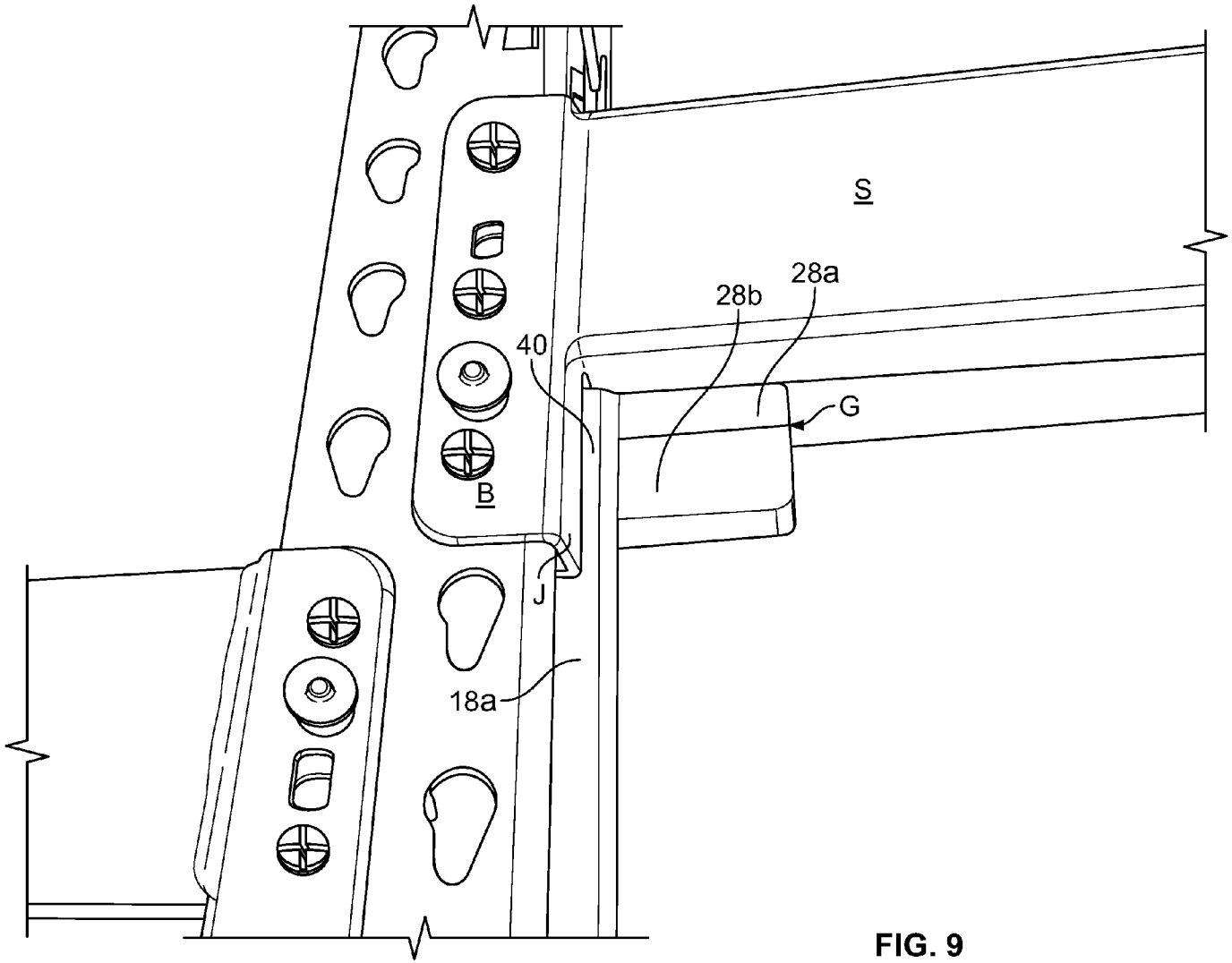
FIG. 9 is a perspective view of a side bracket of the present invention mounted to and flush with a shelving unit.

Also novel is the notch or J-shaped cutout at the upper end 40 of the side brackets 18, 20. The J-shaped cutout allows for clearance under the shelving brace B, as shown in FIG. 8C.

The frame 12 is mounted to a shelf S by the side brackets 18, 20. The side brackets 18, 20 are mounted to the shelving S in the present embodiment by means of hook-like projections 30. No tools are needed to mount the frame 10 to a shelf S. The hook-like projections 30 rest easily within openings O of the vertical spines B of commonly used shelving in stores, providing support and points of attachment for the frame 12.

A T-bracket 32 is used in addition to the hook-like projections 30 to mount the frame 12 to the shelf S. The T-bracket 32 of the present embodiment is formed to engage a shelf opening separate from the openings engaged by the hook-like projections 30; however, it is also contemplated that the T-bracket 32 may engage the same opening as is engaged by a hook-like projection 30. The T-bracket 32 is biased so that it extends into the spine openings O.

Limit stops 36 on the side brackets 18, 20 allow for additional mounting stability. The limit stops 36 prevent the signage from sliding excessively in the horizontal direction and help stabilize the side brackets to prevent twisting or turning of the frame 10 during use. In the present embodiment, the limit stops 36 are shown on the lower portion of the side bracket 18, 20 however it is contemplated that limit stops may be placed in any number of places along the length of the side brackets 18, 20.

The frame can be made of any type of material conducive to the type of mounting apparatus disclosed. In the present embodiment, the upper and lower rails 14, 16 are formed from a powder-coated metal while the side brackets are formed from a polymer or polymer blend substance.

Once the frame is adjusted to the desired height and width, a sign is placed in the two-way adjustable sign mounting system 10 in the well W formed by the lower rail 16 and the recess R provided by the upper rail 14. The sign can be two elements or boards side-by-side that can be slid in relation to one another to provide access to the area behind the sign.

All patents referred to herein, are hereby incorporated by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A two-way adjustable sign system for mounting a sign to a shelf, the system comprising:

a frame, the frame having an upper rail, a lower rail, and a first and a second side brackets, the upper rail and the lower rail each having an inner and an outer rail, wherein the inner rail is slidably moveable within the outer rail, and wherein the first and second side brackets each have an inner and outer bracket wherein the inner bracket is slidably movable within the outer bracket to adjust both the height and width of the frame, wherein the frame is mounted to the shelf without using tools, and wherein the upper and lower rails each have a latching mechanism.

2. The two-way adjustable sign system for mounting a sign to a shelf of claim 1 wherein the upper rail has an asymmetrical C-shaped cross-section wherein a first lip of the upper rail extends forward of a second lip of the upper rail forming a recess for the sign.

3. The two-way adjustable sign system for mounting a sign to a shelf of claim 1 wherein the lower rail has an asymmetrical C-shaped cross-section wherein a first lip of the lower rail extends forward of a second lip of the lower rail forming a well for the sign.

4. The two-way adjustable sign system for attaching to a shelf of claim 1 wherein the latching mechanism is affixed to an inner surface of the inner rail, extends through an opening in the inner rail and engages an aperture in the outer rail.

5. A two-way adjustable sign system for mounting a sign to a shelf, the system comprising:

a frame, the frame having an upper rail, a lower rail, and a first and a second side brackets, the upper rail and the lower rail each having an inner and an outer rail, wherein the inner rail is slidably moveable within the outer rail, and wherein the first and second side brackets each have an inner and outer bracket wherein the inner bracket is slidably movable within the outer bracket to adjust both the height and width of the frame, wherein the first bracket has a tongue having at least two tongue portions capable of engaging the upper or lower rail.

6. A two-way adjustable sign system for mounting a sign to a shelf, the system comprising:

a frame, the frame having an upper rail, a lower rail, and a first and a second side brackets, the upper rail and the lower rail each having an inner and an outer rail, wherein the inner rail is slidably moveable within the outer rail, and wherein the first and second side brackets each have an inner and outer bracket wherein the inner bracket is slidably movable within the outer bracket to adjust both the height and width of the frame, wherein the frame is mounted to the shelf without using tools, and wherein the second bracket has a tongue having at least two tongue portions capable of engaging the upper or lower rail.

7. The two-way adjustable sign system for mounting a sign to a shelf of claim 1 wherein the first and second side brackets have upper ends wherein the upper ends have cutouts allowing for clearance for mounting.

8. The two-way adjustable sign system for mounting a sign to a shelf of claim 1 wherein the first and second side brackets have hook-like projections to mount the frame to the shelf.

9. The two-way adjustable sign system for mounting a sign to a shelf of claim 1 wherein the first and second side brackets have at least one biased T-shaped tab to mount the frame to the shelf.

10. The two-way adjustable sign system for mounting a sign to a shelf of claim 1 wherein the upper rail and lower rail are formed from a metal.

11. The two-way adjustable system for mounting a sign to a shelf of claim 1 wherein the first and second side brackets are formed form a polymer.

12. A two-way adjustable system for mounting a sign to a shelf, the system comprising:

a frame, the frame having an upper rail, a lower rail, and a first and a second side brackets, the upper rail and the lower rail each having an inner and an outer rail, wherein the inner rail is slidably moveable within the outer rail, and wherein the first and second side brackets each have an inner and outer bracket wherein the inner bracket is slidably movable within the outer bracket to adjust both the height and width of the frame, wherein the first and second side brackets have limit stops to prevent excessive horizontal movement of the sign.

* * * * *